US011035122B1

(12) United States Patent
Sorkin

(10) Patent No.: US 11,035,122 B1
(45) Date of Patent: Jun. 15, 2021

(54) INTERMEDIATE CONCRETE ANCHOR SYSTEM WITH CAP

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 16/822,846

(22) Filed: Mar. 18, 2020

(51) Int. Cl.

| | |
|---|---|
| ***E04C 5/12*** | (2006.01) |
| ***E04G 15/04*** | (2006.01) |
| ***E04G 21/12*** | (2006.01) |
| *E04C 5/16* | (2006.01) |

(52) U.S. Cl.
CPC ..... *E04C 5/122* (2013.01); *E04G 15/04* (2013.01); *E04G 21/12* (2013.01); *E04C 5/161* (2013.01); *E04C 5/163* (2013.01); *E04C 5/168* (2013.01)

(58) Field of Classification Search
CPC . E04C 5/122; E04C 5/12; E04C 5/161; E04C 5/163; E04C 5/168; E04G 15/04; E04G 21/12
See application file for complete search history.

(56) References Cited

U.S. PATENT DOCUMENTS

| | | | |
|---|---|---|---|
| 4,773,198 | A | 9/1988 | Reinhardt |
| 4,896,470 | A | 1/1990 | Sorkin |
| 5,072,558 | A | 12/1991 | Sorkin et al. |
| 5,436,425 | A | 7/1995 | Sorkin |
| 5,440,842 | A | 8/1995 | Sorkin |
| 5,701,707 | A | 12/1997 | Sorkin |
| 5,720,139 | A | 2/1998 | Sorkin |
| 5,749,185 | A | 5/1998 | Sorkin |
| 5,755,065 | A | 5/1998 | Sorkin |
| 5,770,286 | A | 6/1998 | Sorkin |
| 5,788,398 | A | 8/1998 | Sorkin |
| 5,839,235 | A | 11/1998 | Sorkin |
| 5,897,102 | A | 4/1999 | Sorkin |
| 6,012,867 | A | 1/2000 | Sorkin |
| 6,017,165 | A | 1/2000 | Sorkin |
| 6,023,894 | A | 2/2000 | Sorkin |

(Continued)

FOREIGN PATENT DOCUMENTS

| | | | |
|---|---|---|---|
| EP | 3564457 | A1 | 11/2019 |

OTHER PUBLICATIONS

Extended European Search Report issued in EP App. No. 20164265.9, dated Oct. 19, 2020 (6 pages).

*Primary Examiner* — Andrew J Triggs
(74) *Attorney, Agent, or Firm* — Locklar PLLC

(57) ABSTRACT

A method and system for forming a post-tensioned concrete slab using a post-tensioning concrete anchor. The system may comprise a connector anchor including a bore that includes a first frustoconical portion, and the connector anchor may be adapted to bear on the post-tensioning concrete anchor. The system may also comprise a coupler comprising a connector and a coupler body that includes a second frustoconical portion that is oriented oppositely to the first frustoconical portion. The connector may have a bore therethrough and may be configured to receive the coupler body and to engage the connector anchor. A pocket-forming cap may releasably engage the post-tensioning concrete anchor; the pocket-forming cap may include a frustoconical wall, a gripping head, and a connector-receiving portion. The method may include using the system to form a second concrete section adjacent to a first concrete section before stressing the first concrete section.

12 Claims, 7 Drawing Sheets

(56) References Cited

U.S. PATENT DOCUMENTS

| | | | | |
|---|---|---|---|---|
| 6,027,278 | A | 2/2000 | Sorkin | |
| 6,040,546 | A | 3/2000 | Sorkin | |
| 6,098,356 | A | 8/2000 | Sorkin | |
| 6,151,850 | A * | 11/2000 | Sorkin | E04C 5/08 52/223.1 |
| 6,176,051 | B1 * | 1/2001 | Sorkin | E04C 5/08 403/305 |
| 6,234,709 | B1 | 5/2001 | Sorkin | |
| 6,380,508 | B1 | 4/2002 | Sorkin | |
| 6,381,912 | B1 | 5/2002 | Sorkin | |
| 6,393,781 | B1 | 5/2002 | Sorkin | |
| 6,513,287 | B1 | 2/2003 | Sorkin | |
| 6,560,939 | B2 | 5/2003 | Sorkin | |
| 6,631,596 | B1 | 10/2003 | Sorkin | |
| 6,761,002 | B1 * | 7/2004 | Sorkin | E04C 5/12 403/374.1 |
| 6,817,148 | B1 | 11/2004 | Sorkin | |
| 6,843,031 | B1 | 1/2005 | Sorkin | |
| 7,216,842 | B2 * | 5/2007 | Watson | B28B 7/28 249/142 |
| 7,424,792 | B1 | 9/2008 | Sorkin | |
| 7,676,997 | B1 | 3/2010 | Sorkin | |
| D615,219 | S | 5/2010 | Sorkin | |
| 7,823,345 | B1 | 11/2010 | Sorkin | |
| 7,841,061 | B1 | 11/2010 | Sorkin | |
| 7,856,774 | B1 | 12/2010 | Sorkin | |
| 7,866,009 | B1 | 1/2011 | Sorkin | |
| 7,950,196 | B1 | 5/2011 | Sorkin | |
| 8,015,774 | B1 | 9/2011 | Sorkin | |
| 8,065,845 | B1 | 11/2011 | Sorkin | |
| 8,069,624 | B1 | 12/2011 | Sorkin | |
| 8,087,204 | B1 | 1/2012 | Sorkin | |
| 8,251,344 | B1 | 8/2012 | Sorkin | |
| 9,097,014 | B1 | 8/2015 | Sorkin | |
| 9,303,406 | B2 | 4/2016 | Sorkin | |
| 9,604,416 | B2 | 3/2017 | Sorkin | |
| 2006/0033003 | A1 * | 2/2006 | Watson | E04C 5/12 249/177 |
| 2018/0291628 | A1 * | 10/2018 | Butts | E04C 5/122 |
| 2019/0338523 | A1 * | 11/2019 | Hayes | E04C 5/02 |

* cited by examiner

INTERMEDIATE CONCRETE ANCHOR SYSTEM WITH CAP

TECHNICAL FIELD/FIELD OF THE DISCLOSURE

The present disclosure relates generally to post-tensioning anchors. More particularly, the present disclosure relates to a system and method used in post-tensioning concrete.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, foundations, sports courts, and other structures.

Prestressed concrete is structural concrete in which internal stresses are introduced to the concrete member to reduce potential tensile stresses in the concrete resulting from applied loads. Prestressing may be accomplished by post-tensioned prestressing or pre-tensioned prestressing. In post-tensioned prestressing, a post-tensioning tendon may provide a tension member that can be tensioned after the concrete has attained a specified strength. The post-tensioning tendon may include for example and without limitation, anchors, the tension member, and sheaths or ducts. A tension member could be any suitable material exhibiting tensile strength which can be elongated including, for example and without limitation, reinforcing steel, single or multi-strand cable. The tension member may be formed from a metal or composite.

A post-tensioning tendon typically includes an anchor at each end. The tension member is fixedly coupled to an anchor positioned at one end of the tension member, sometimes referred to as the "fixed" anchor, and is adapted to be stressed at a second anchor that is spaced-apart from the fixed-end anchor, sometimes referred to as the "stressing" or "live" anchor. The tension member is stressed by pulling the tension member through the stressing anchor; when the pulling force is released, the anchors grip the tension member and retain the tension member in tension. In some instances, the anchors grip the tension member using wedges, so that the gripping force increases when the tension on the tension member increases.

The concrete may be poured into a concrete form. The concrete form may be a form or mold into which concrete is poured or otherwise introduced to give shape to the concrete as it sets or hardens thus forming a concrete member.

In post-tension systems where the length of the desired concrete member is too long to pour as a single slab or too long to tension with a single anchor, the desired concrete member may be formed from multiple concrete sections and intermediate anchors may be employed. Each intermediate anchor may be attached to a concrete form that defines a concrete section. The concrete is stressed section by section. Intermediate anchors and associated systems may be employed whenever it is desired to form concrete member from multiple, separately-stressed sections, such as when the desired concrete member is so long that a single live anchor (or stressing anchor) extending to a single dead end anchor (or fixed anchor) is inadequate.

In some cases, to allow access to the stressing-end of a post-tensioning tendon once the concrete is poured, a pocket former may be used to prevent or restrict concrete from filling the area between the stressing anchor and the concrete form used to form the concrete member. Once the concrete has sufficiently hardened and the concrete form is removed, the pocket former is removed from the concrete member. Traditionally, pocket formers are tapered (frustoconical). Tapered pocket formers may allow for easier removal from the concrete member. Typically, once the pocket former is removed and the post-tensioning tendon has been stressed by applying tension to the strand (cable), thereby forming a post-tensioned concrete member, the pocket formed by the pocket former is filled with a material such as a cementitious chloride-free grout or concrete to, for example, provide fire protection and corrosion protection. In the case of an intermediate anchor, the pocket may be filled with concrete when the subsequent (adjacent) section of concrete is poured.

The construction of a structure may include a series of steps, including, but not limited to, assembling a concrete form for one concrete section, pouring the concrete to form the concrete section, curing or hardening the concrete, and stressing the concrete section. One factor in the time required for the construction of the structure is the dependence of the completion of each concrete section on the completion of other concrete sections.

SUMMARY

A system for use with a post-tensioning concrete anchor may comprise a connector anchor and a coupler. The connector anchor may include a bore therethrough, the bore may include a first frustoconical portion, and the connector anchor may be adapted to bear on the post-tensioning concrete anchor. The coupler may comprise a coupler body and a connector. The coupler body may include a bore therethrough, the bore may include a second frustoconical portion, and the second frustoconical portion may be oriented oppositely to the first frustoconical portion. The connector may have a bore therethrough and may be configured to receive the coupler body therein. The connector may be adapted to mechanically engage the connector anchor such that a tensioning force can be transmitted from the coupler body to the connector anchor via the connector. The connector may engage the connector anchor via mating threads.

The system may further include a first spacer retained in the connector so as to retain the coupler body in the connector. The system may further include a second spacer disposed between the coupler encapsulation and an end of the connector. The first and second spacers may each comprise a crushable material or an annular elastomeric member. The system may further comprise a spacer sleeve between the first spacer and an inner wall of the connector.

The system may further include a coupler encapsulation encapsulating an outer surface of the connector and a tubular seal mechanically coupled to the coupler encapsulation.

A method for forming a concrete member using first and second concrete forms, the first concrete form having first and second ends, may comprise the steps of: a) assembling a first tendon for a first concrete section, the first tendon including a first stressing anchor, a fixed anchor, and a first tension member affixed to the first stressing anchor and the fixed anchor, the fixed anchor comprising an anchor body and a connector anchor mechanically coupled to the anchor body, b) affixing the first stressing anchor to the first concrete form first end and affixing the fixed anchor to the first concrete form second end; c) pouring concrete into the first concrete form so as to form a first concrete section in which the first stressing anchor and the fixed anchor are embedded; d) assembling a second tendon for a second concrete section, the second tendon including a coupler, a second stressing anchor, and a second tension member affixed to the coupler and the second stressing anchor, the coupler including a coupler body and a connector, wherein coupler body may be disposed in the connector and the connector is mechanically coupled to the connector anchor so as to retain the coupler to the fixed anchor such that a tensioning force can be transmitted from the coupler body to the connector anchor via the connector; e) affixing the second stressing anchor to the second concrete form; f) pouring concrete into the second concrete form so as to form a second concrete section which is adjacent to the first concrete section and in which the coupler and the second stressing anchor are embedded; g) stressing the first tendon at the first stressing anchor; and h) stressing the second tendon at the second stressing anchor. Step d) may be carried out before step g). Step f) may be carried out before step g).

The connector anchor may include a bore therethrough. The connector anchor bore may include a first frustoconical portion, the coupler body may include a bore therethrough, the coupler body bore may include a second frustoconical portion, the second frustoconical portion may be oriented oppositely to the first frustoconical portion, and the first and second frustoconical portions may each include at least one wedge disposed therein.

Step a) may include threading the first tension member through the first stressing anchor and the connector anchor. The anchor body may include an anchor encapsulation and step a) may further include mechanically coupling the connector anchor to the anchor encapsulation.

Step d) may include threading the second tension member through the coupler body and the second stressing anchor and mechanically coupling the connector to the connector anchor. Step d) may further include mechanically coupling the connector to the connector anchor.

The coupler may further include a coupler encapsulation encapsulating an outer surface of the connector and a tubular seal mechanically coupled to the coupler encapsulation. The coupler may further include a first spacer retained in the connector so as to retain the coupler body in the connector. The coupler may further include a second spacer disposed between the coupler encapsulation and an end of the connector. The first and second spacers may each comprise a crushable material or an annular elastomeric member. The connector may engage the connector anchor via mating threads.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
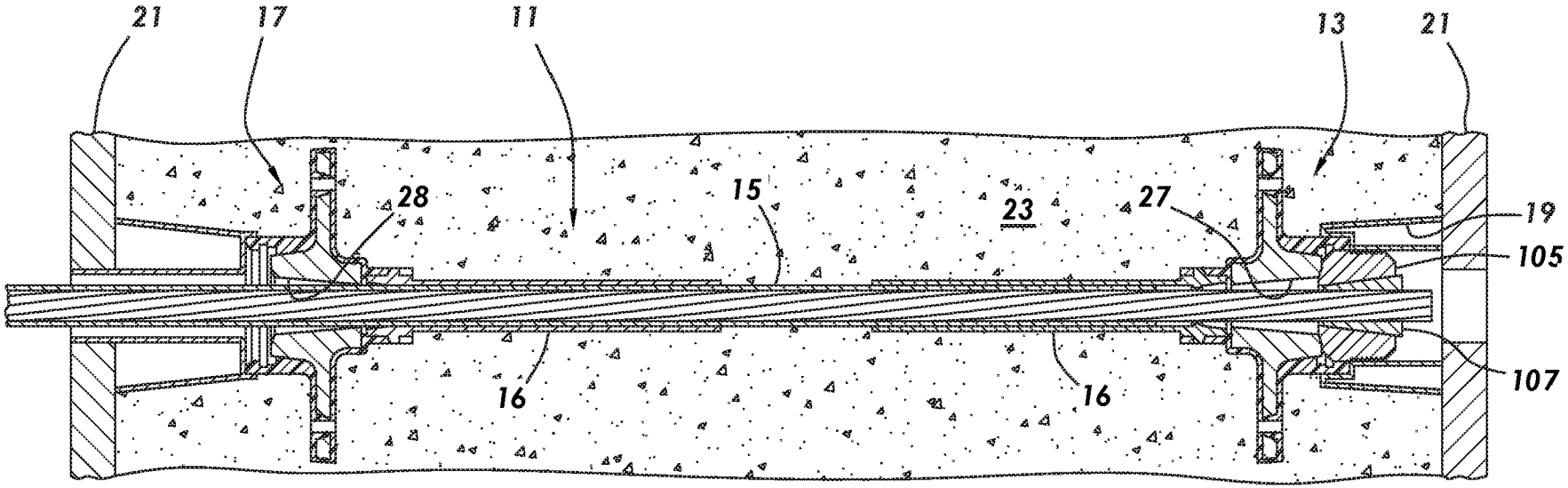
FIG. 1 is a cross section showing a step in a concrete pouring operation consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

When forming a concrete member to be post-tensioned, anchors may be provided to hold the tendon both before and after stressing.

Apparatus

In some embodiments, as depicted in FIG. 1, first post-tensioning tendon 11 may be positioned within first concrete form 21. First post-tensioning tendon 11 may include, for example, and without limitation, first anchor 13 positioned at a first position within first concrete form 21, first tension member 15, and second anchor 17 positioned at a second position within first concrete form 21. First tension member 15 may extend between and through first anchor 13 and second anchor 17. In some embodiments, first post-tensioning tendon 11 may also include a sheath positioned about first tension member 15 and one or more seals 16 between the sheath and each anchor, 13, 17. The sheath and seals 16 may, for example, protect first tension member 15 from corrosion after first concrete section 23 is poured. Additionally, the sheath and seals 16 may, for example, reduce or prevent concrete from ingressing into first tension member 15 and preventing or retarding its tensioning as discussed below. In some embodiments, seal 16 for first anchor 13 may be omitted. As used herein, "tension member" refers to any cable, strand, or the like that may be used to apply stress to a post-tensioned concrete form.

Figure 2:
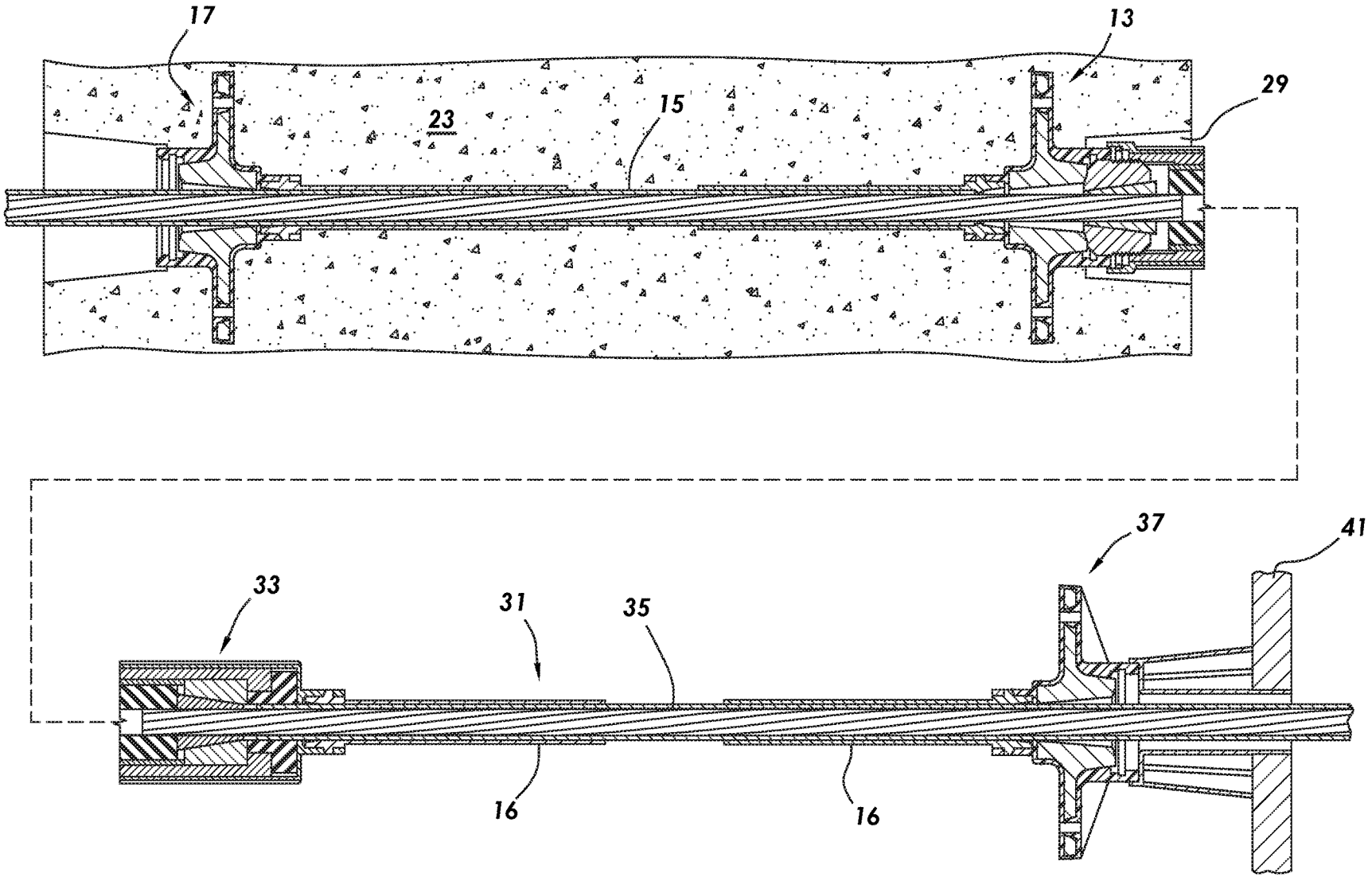
FIG. 2 is a cross section showing a further step in a concrete pouring operation consistent with at least one embodiment of the present disclosure.

First and second anchors 13, 17 may each include a frustoconical passage, 27, 28, respectively, through which the tensioning member extends. Gripping wedges (not shown) may be positioned in frustoconical passages, 27, 28 so that first and second anchors 13, 17 may grip the tensioning member and maintain a tensioning force thereon, as is known. In some embodiments, first and second anchors 13, 17 may be positioned within first concrete form 21 such that first and second anchors 13, 17 will be at least partially encased in first concrete section 23 when form 21 is filled. In some embodiments, as depicted in FIG. 2, second post-tensioning tendon 31 may be assembled and positioned within a second concrete form 41 that is adjacent to first concrete section 23. Second post-tensioning tendon 31 may include, for example, and without limitation, coupler 33, second tension member 35, and a third anchor 37. Second tension member 35 may extend between coupler 33 and third anchor 37.

Second anchor 17 and third anchor 37 may each be stressing anchors configured for use with wedges, seals and/or pocket formers. Thus, second anchor 17 and third anchor 37 each allow the application of stressing force to a tension member extending therethrough. In some instances, such as when it is desired to include third or further concrete sections, third anchor 37 may function in the manner described below with respect to first anchor 13, i.e. third anchor 37 may be connected to a coupler and serve as a fixed anchor for an additional tendon.

As with first post-tensioning tendon 11, second post-tensioning tendon 31 may include a sheath positioned about second tension member 35 and one or more seals 16 between the sheath and each anchor. The sheath and seals may, for example, protect second tension member 35 from corrosion after second concrete section 25 is poured. Additionally, the sheath and seals may, for example, reduce or prevent concrete from ingressing into second tension member 35 and preventing or retarding its tensioning, as discussed below. In some embodiments, a seal for coupler 33 may be omitted. In some embodiments, coupler 33 may be positioned within second concrete form 41 such that coupler 33 will be encased in second concrete section 25, as described below.

Figure 3:
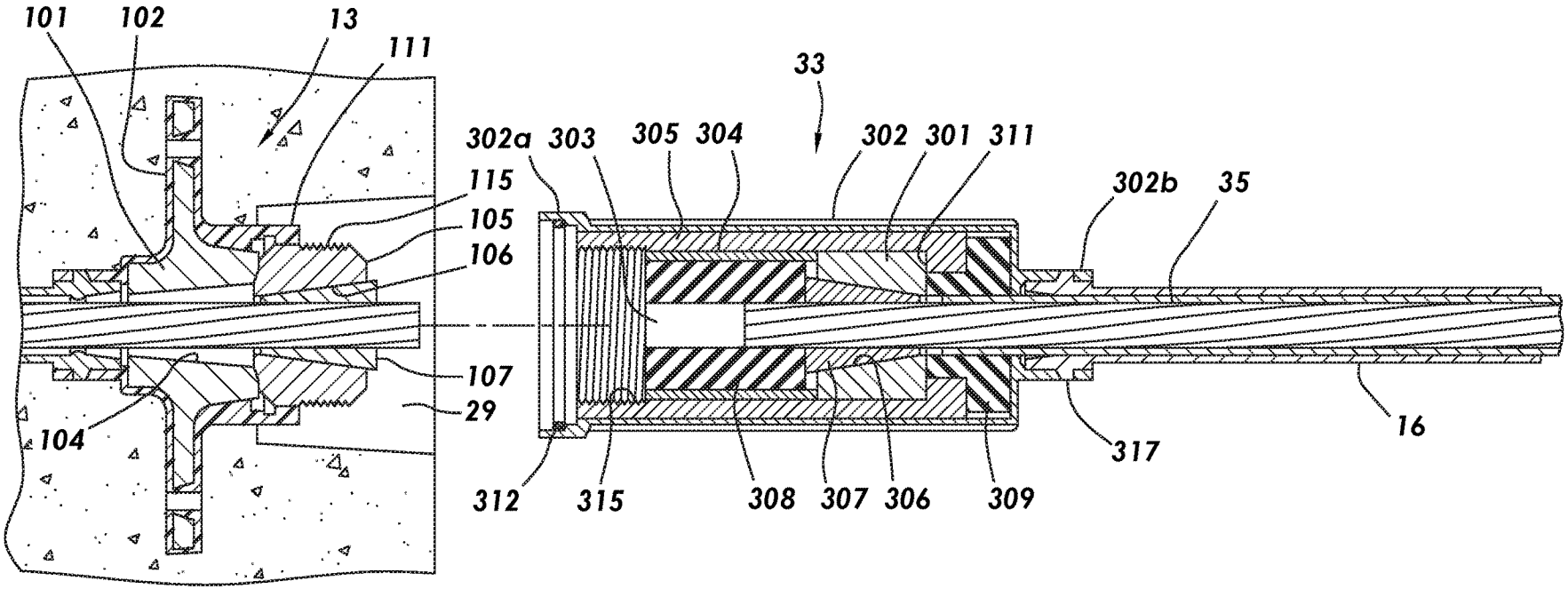
FIG. 3 is an exploded view of an anchor and a coupler consistent with at least one embodiment of the present disclosure.

Referring now to FIG. 3, in some embodiments, first anchor 13 may include first anchor body 101, which may be encapsulated in an encapsulating layer or cover, referred to as anchor encapsulation 102. Anchor encapsulation 102 may include lip 111 that extends longitudinally beyond first anchor body 101. Anchor encapsulation 102 may, for example, protect first anchor body 101 from corrosion after first concrete section 23 is poured. Additionally, anchor encapsulation 102 may, for example, reduce or prevent concrete from ingressing into first anchor body 101 and first tension member 15 and preventing or retarding tensioning. First anchor body 101 may be positionable within first concrete form 21 and coupleable to first tension member 15 so as to retain the position of first anchor body 101 within first concrete section 23 once first concrete section 23 sets. In some embodiments, first anchor body 101 may retain first anchor 13 in position under tension when positioned in first concrete section 23.

In some embodiments, first anchor body 101 may include a bore therethrough for receiving first tension member 15. In some embodiments, the bore through first anchor body 101 may also include a frustoconical passage 104. In some embodiments, a pocket-forming element such as pocket former 19 (FIG. 2) may be positioned between first anchor 13 and first concrete form 21 so as to create a pocket 29 (FIG. 3) in first concrete section 23 so as to allow access to first anchor 13 when first concrete form 21 and pocket former 19 are removed from first concrete section 23.

Still referring to FIG. 3, in some embodiments, an annular connector anchor 105 may be used in conjunction with first anchor 13. Connector anchor 105 may be mechanically coupled to first anchor body 101 by, including without limitation, a press-fit or threaded engagement with anchor encapsulation lip 111 or with first anchor body 101, or both. In some embodiments, connector anchor 105 is not mechanically coupled to first anchor body 101. Connector anchor 105 may include a bore therethrough and the bore may include a frustoconical portion 106 adapted to receive one or more wedges 107 therein. Connector anchor 105 may further include threads as described in further detail below. In some embodiments, connector anchor 105 or pocket former 19 may include a spacer, spring, or frictionally engaged member, for retaining wedges 107 in connector anchor 105 until a tensioning force applied to first tension member 15 is sufficient to retain wedges 107. In still other embodiments, connector anchor 105 is not connected to first anchor body 101 until after first concrete form 21 has been removed. In such instances, connector anchor 105 may be connected to coupler 33 before being placed into engagement with first anchor 13.

In some embodiments, one or more wedges can be provided in frustoconical passage 104 in first anchor body 101, either alternatively or in addition to wedges 107 in connector anchor 105. Similarly, a removable pocket-forming cap may be included on first anchor 13 as described below (FIGS. 5-8). By way of example, and as described in detail below, a pocket-forming cap 400 may be affixed to connector anchor 105 and used in combination with first concrete form 21, then removed and replaced with coupler 33 in conjunction with construction of second concrete form 41.

Still referring to FIG. 3, in some embodiments, coupler 33 may include coupler body 301, coupler encapsulation 302, threaded connector 305, and first and second spacers 308, 309. Coupler 33 may include bore 303 therethrough for receiving second tension member 35. The bore through coupler body 301 may include frustoconical portion 306 adapted to receive one or more wedges 307. Connector 305 may be annular and may include an inner shoulder 311 on which coupler body 301 seats. In some embodiments, connector 305 may include threads 315 configured to engage corresponding mating threads 115 on connector anchor 105. In some embodiments, the threads 115 on connector anchor 105 are male threads and the threads 315 on connector 305 are female threads. In other embodiments, connector anchor 105 and connector 305 may be mechanically coupled by other suitable mechanisms, including but not limited to press-fit, bayonet connection, and set screws.

In some embodiments, coupler encapsulation 302 may surround an outer surface of connector 305 and may have first and second ends 302*a*, 302*b*, respectively. In some embodiments, each of first and second ends 302*a*, 302*b* extends beyond connector 305. First end 302*a* may be configured to sealingly engage lip 111 by any suitable means, including but not limited to a friction fit. If desired, a seal such as an O-ring 312 may be included to enhance the seal formed between lip 111 and first end 302*a*. Second end 302*b* extends sufficiently beyond coupler 33 configured to enclose second spacer 309. Second end 302*b* may also include an outwardly extending portion that is adapted to sealingly engage a tubular seal 16 or a sheath on a tension member. By way of example, coupler encapsulation 302 may engage a tubular seal 16 by means of one or more locking tabs 317.

First and second spacers 308 and 309 may each be annular and may each comprise an elastomer, elastomer foam, or crushable foam. First spacer 308 may frictionally engage the interior wall of connector 305; in some embodiments, an optional spacer sleeve 304 may also be included therebetween. Spacer sleeve 304 may be a retaining sleeve that serves to support first spacer 308. Spacer sleeve 304 may be made of a harder material than first spacer 308, such as a solid polymer. First spacer 308 serves to retain wedge(s) 307 within coupler body 301 before a tension member is inserted therethrough and to limit that volume of empty space in coupler 33. First spacer 308 may comprise a crushable material. As used herein, "crushable" refers to a material whose density can be increased with a pressure less than the pressure that would be applied when a standard post-tensioning force is applied to the tensioning member. An example of a suitable material is a polymer foam, including, but not limited to, foamed polystyrene. In instances in which connector anchor 105 is connected to coupler 33 before being placed into engagement with first anchor 13, first spacer 308 may also serve to retain wedge(s) 107 in connector anchor 105. Second spacer 309 may maintain coupler body 301 and connector 305 in a desired configuration within coupler 33 during handling and/or may enhance sealing between second tension member 35 and coupler 33 when installed.

Referring to FIGS. 5-8, an exemplary pocket-forming cap 400 consistent with some embodiments may include such elements as frustoconical pocket-forming wall 402, gripping head 404 (FIG. 6), base 406, anchor-receiving portion 407, anchor seat 408, inner wall 410, shoulder 412, connector-receiving portion 413, cable-receiving well 414, and end wall 416. Gripping head 404 may be used to grip, rotate, place and/or remove pocket-forming cap 400. Gripping head 404 may be hexagonal or may have any other desired shape. A pocket-forming cap may omit one or more of the foregoing elements or may include one or more elements in a configuration that is different from the illustrated configuration.

Pocket-forming wall 402 is sized and configured to form a pocket having a desired size and shape when concrete is poured around the outside of the pocket-forming cap 400. The desired shape may be frustoconical, as in the illustrated embodiment. In some embodiments, as illustrated in phantom in FIG. 6, the surface of pocket-forming wall 402 may include an integral or removable boss 403. If present, boss 403 forms a groove in the wall of a concrete pocket formed by pocket-forming cap 400, thereby providing enhanced retention of grout or other material that may subsequently be placed in the pocket.

Figure 7:
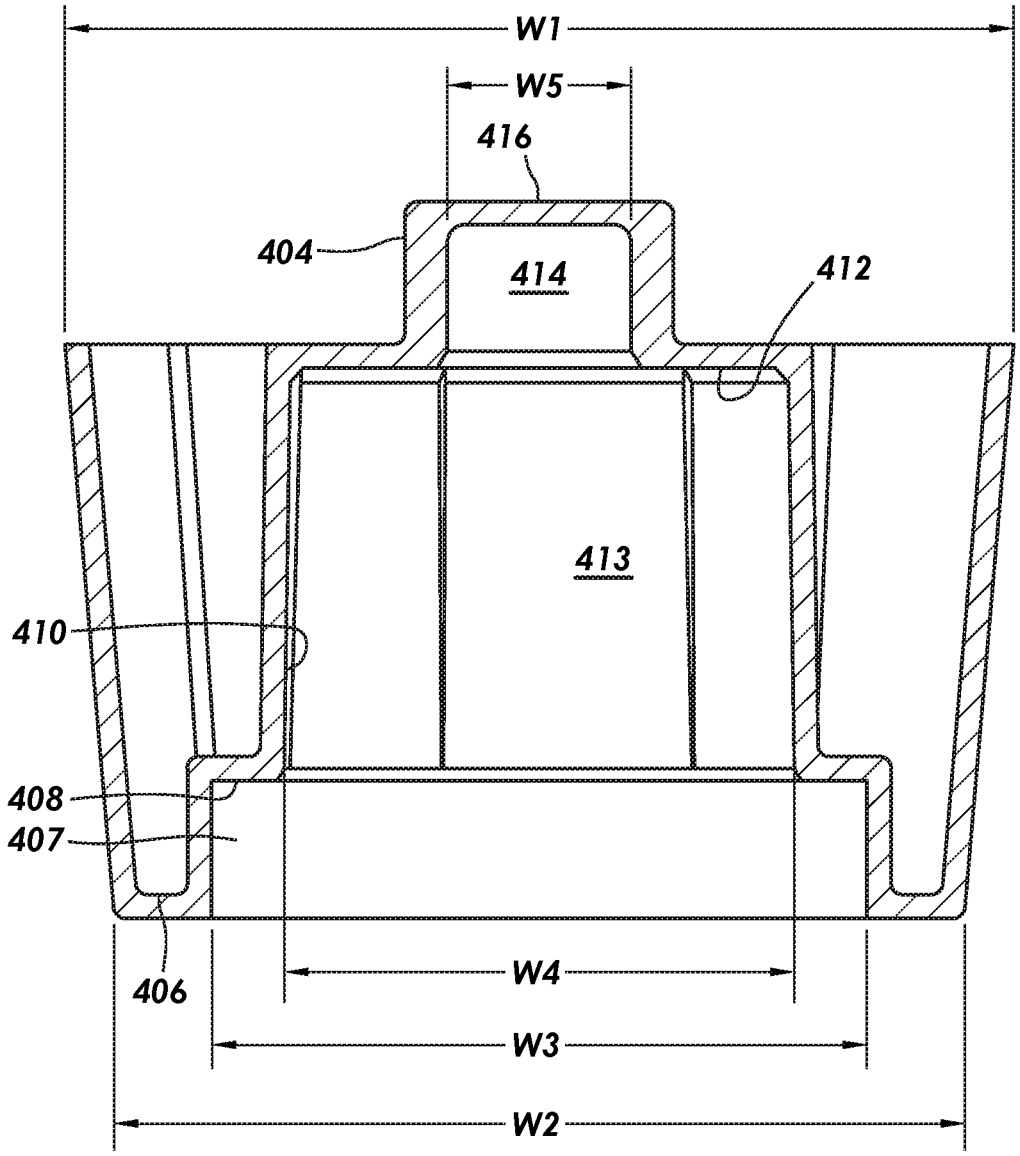
FIG. 7 is a cross section through the axis of the pocket-forming cap of FIG. 5.

Pocket-forming wall 402 extends from base 406, which serves to define the bottom of a pocket formed by pocket-forming cap 400, to an lip 405. In some embodiments, lip 405 may bear on an inner surface of a concrete form, e.g. first concrete form 21 (FIG. 1), when in use. Referring to FIG. 7, the largest diameter of pocket-forming wall 402, W1, occurs at lip 405 and the smallest diameter, W2, occurs at base 406. Base 406 may extend from W2 to a smaller third diameter W3, which is the diameter of anchor-receiving portion 407.

Figure 6:
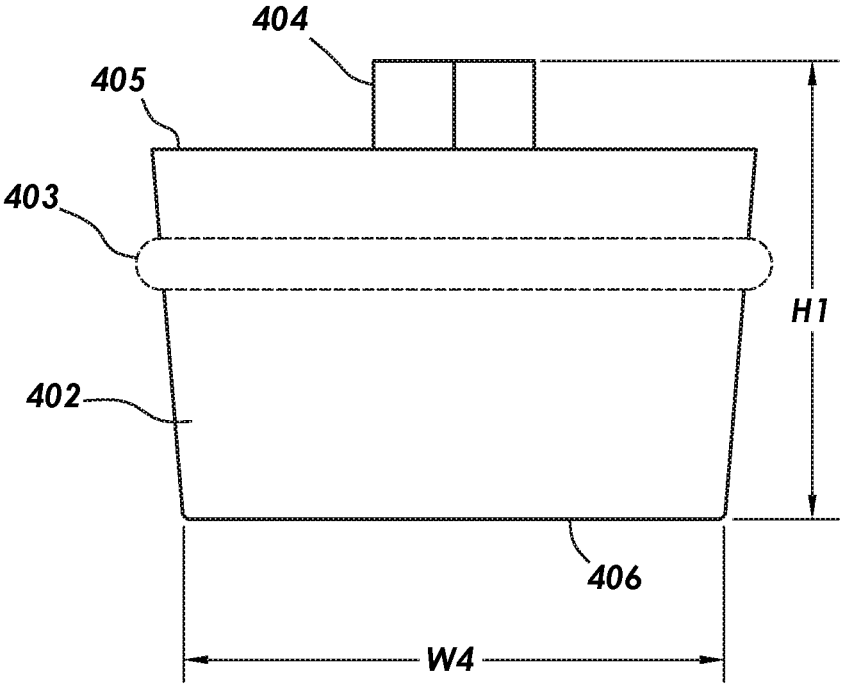
FIG. 6 is a side view of the pocket-forming cap of FIG. 5.

As shown in FIG. 6, gripping head 404 may extend along the longitudinal axis of pocket-forming cap 400 and may extend beyond lip 405 to facilitate access to the gripping head 404. The total height of pocket-forming cap 400 from base 406 to the end of gripping head 404 may be Hl. To facilitate gripping thereof, the outer surface of gripping head 404 may be square, hexagonal, round, or other shape and may include knurls or other features.

Anchor seat 408 is axially spaced inwardly from base 406 and defines the extent of anchor-receiving portion 407. Anchor seat 408 may extend from third diameter W3 to a smaller fourth diameter W4, which is a diameter of inner wall 410. Inner wall 410 may be cylindrical or frustoconical and extends longitudinally from anchor seat 408 to shoulder 412. Together, inner wall 410 and shoulder 412 define a connector-receiving portion 413 that is configured to receive connector anchor 105 therein. In some embodiments, the longitudinal distance from base 406 to shoulder 412 may be less than or substantially the same as the longitudinal distance from base 406 to lip 405. Shoulder 412 may extend from W4 to a smaller fifth diameter W5, which is the diameter of cable-receiving well 414. Cable-receiving well 414 may be enclosed by end wall 416.

Figure 8:
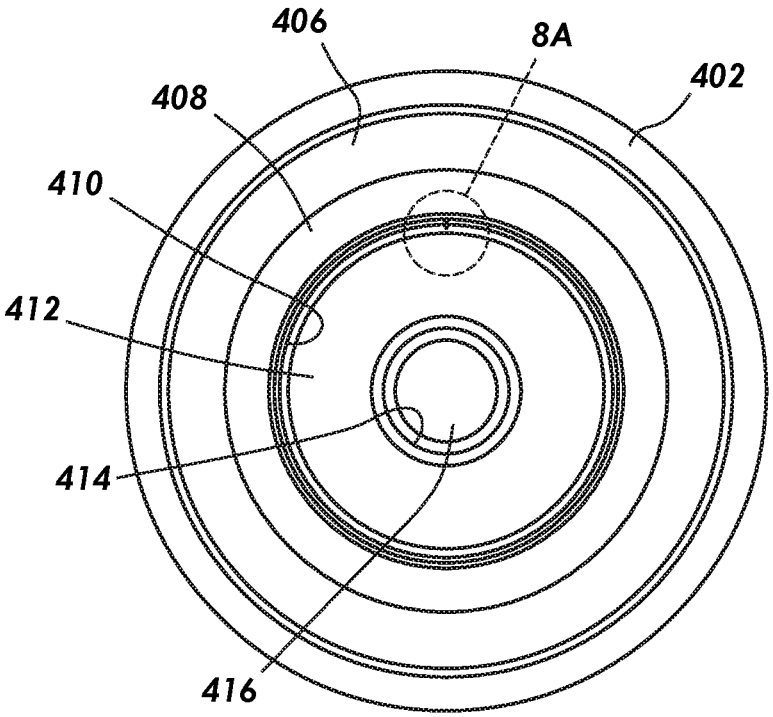
FIG. 8 is an end view of the inside of the pocket-forming cap of FIG. 5.
Figure 8A:
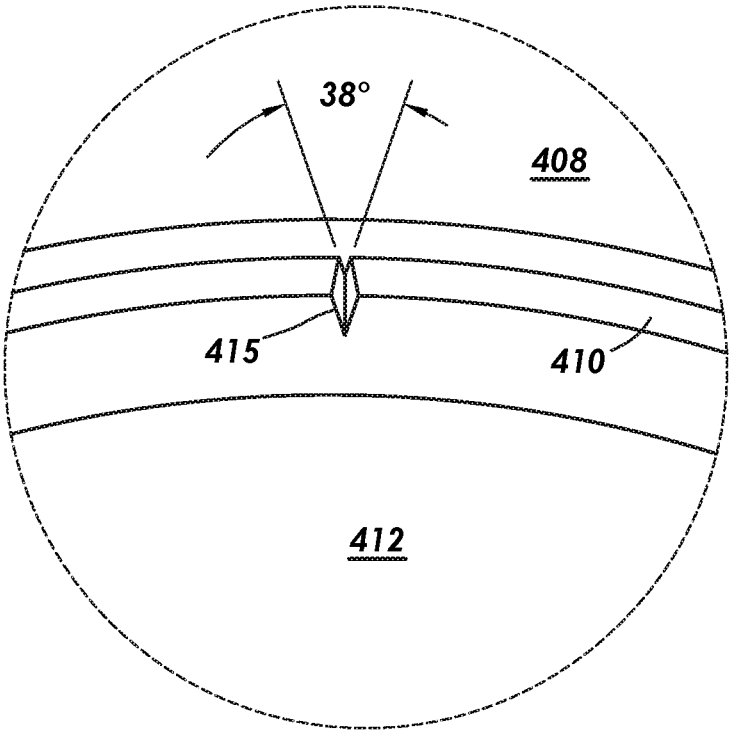
FIG. 8A is an enlarged view of a portion of FIG. 8.

As shown in FIG. 8 and enlarged detail in FIG. 8A, inner wall 410 may include an engagement feature 415 for engaging the outer surface of a connector anchor such as 105. Engagement feature 415 may be any suitable feature, such as a tab or boss, and may engage threadedly, frictionally, or elastically.

Method

In operation and as depicted in FIG. 1, a first concrete section may be formed by constructing a first concrete form 21, placing first and second anchors 13, 17 therein, assembling a first tension member 15 therebetween, and pouring concrete into the form. In some embodiments, first anchor 13 may be part of an anchor assembly that includes first anchor body 101 and its associated anchor encapsulation 102, a connector anchor 105 affixed to anchor encapsulation 102 or first anchor body 101, wedges 107 disposed in connector anchor 105 and a pocket former such as pocket former 19 or pocket-forming cap 400. In some embodiments, the anchor assembly may further include first tension member 15. In some embodiments, the components of an anchor assembly may be pre-assembled off-site and shipped to the concrete-pouring site. In other embodiments, the components of an anchor assembly may be assembled at the concrete-pouring site. In some embodiments, a pre-assembled anchor assembly may further include first and second anchors 13, 17 and first tension member 15.

In an anchor assembly, pocket-forming cap 400 may engage connector anchor 105 by any suitable means, including but not limited to press-fit, bayonet, tabs, threads, partial threads, or the like. An outwardly extending portion of anchor encapsulation 102 and the connector anchor 105, if present, may be received in anchor-receiving portion 407 of the pocket former. The pocket former such as pocket former 19 or pocket-forming cap 400 may be temporarily mechanically coupled to connector anchor 105 by engagement of engagement feature 415 therewith. Shoulder 412 of pocket-forming cap 400 may retain wedges 107 substantially within connector anchor 105. If a tension member (cable) is included in the assembly, a portion of the tension member that may extend beyond wedges 107 may be received in cable-receiving well 414.

In this configuration, when first anchor body 101 is affixed to first concrete form 21, the lip 405 of the pocket-forming cap 400 bears on form 21. When concrete is poured into first concrete form 21, the anchor assembly is embedded and pocket-forming wall 402 defines a pocket in the concrete. Once first concrete section 23 has cured or attained a predetermined hardness, the first concrete form 21 and the pocket former, which may be a pocket-forming cap 400, may be removed. Once first concrete section 23 has cured or attained a predetermined hardness, first concrete section 23 can be tensioned at any desired time by stressing first tension member 15 at second anchor 17. When a tensioning force is applied to first tension member 15 at second anchor 17, connector anchor 105 retains the other end of first tension member 15 and bears on first anchor body 101. In this step, first anchor 13 functions as a fixed, or dead, anchor.

In FIG. 2, first concrete section 23 has been poured and cured but may not have been not post-tensioned. The pocket former has been removed, leaving a pocket 29. Second concrete form 41 for a second concrete section has been assembled. In some embodiments, and as described in detail below, the pocket former may be replaced with coupler 33 in conjunction with the preparation of second concrete form 41. By way of example only, the present system and method may be used to form a post-tensioned concrete member having at least one intermediate anchor and at least two concrete sections.

Provided one end of first tension member 15 is engaged by wedge(s) 107 of connector anchor 105, it is not necessary to maintain access to first tension member 15 at first anchor 13, as first tension member 15 can be stressed at second anchor 17. Thus, coupler 33 can be placed into engagement with first anchor 13 before first concrete section 23 has been stressed. More specifically, connector 305 may be threaded into engagement with connector anchor 105 and a second tension member 35 may be extended between coupler 33 and a further third anchor 37. In this respect, the combination of first anchor 13 and coupler 33 is configured to act as a second fixed anchor, capable of resisting tension force in a direction opposite to the direction of first anchor 13. When coupler 33 is placed into engagement with first anchor 13, first end 302*a* of coupler encapsulation 302 may sealingly engage lip 111 of anchor encapsulation 102, compressing optional O-ring 312 therebetween, so as to form a fluid-tight unit that prevents the ingress of liquid into the resulting assembly and, more particularly, into first and second tension members 15, 35.

An end of second tension member 35 may be inserted into coupler 33, and more particularly into engagement with wedges 307 in coupler body 301, before coupler 33 is placed into engagement with first anchor 13. Alternatively, an end of second tension member 35 can be inserted into coupler 33 after coupler 33 is placed into engagement with first anchor 13. The use of coupler 33 allows construction and filling of a second concrete form 41 to proceed before first concrete section 23 has been stressed.

Figure 4:
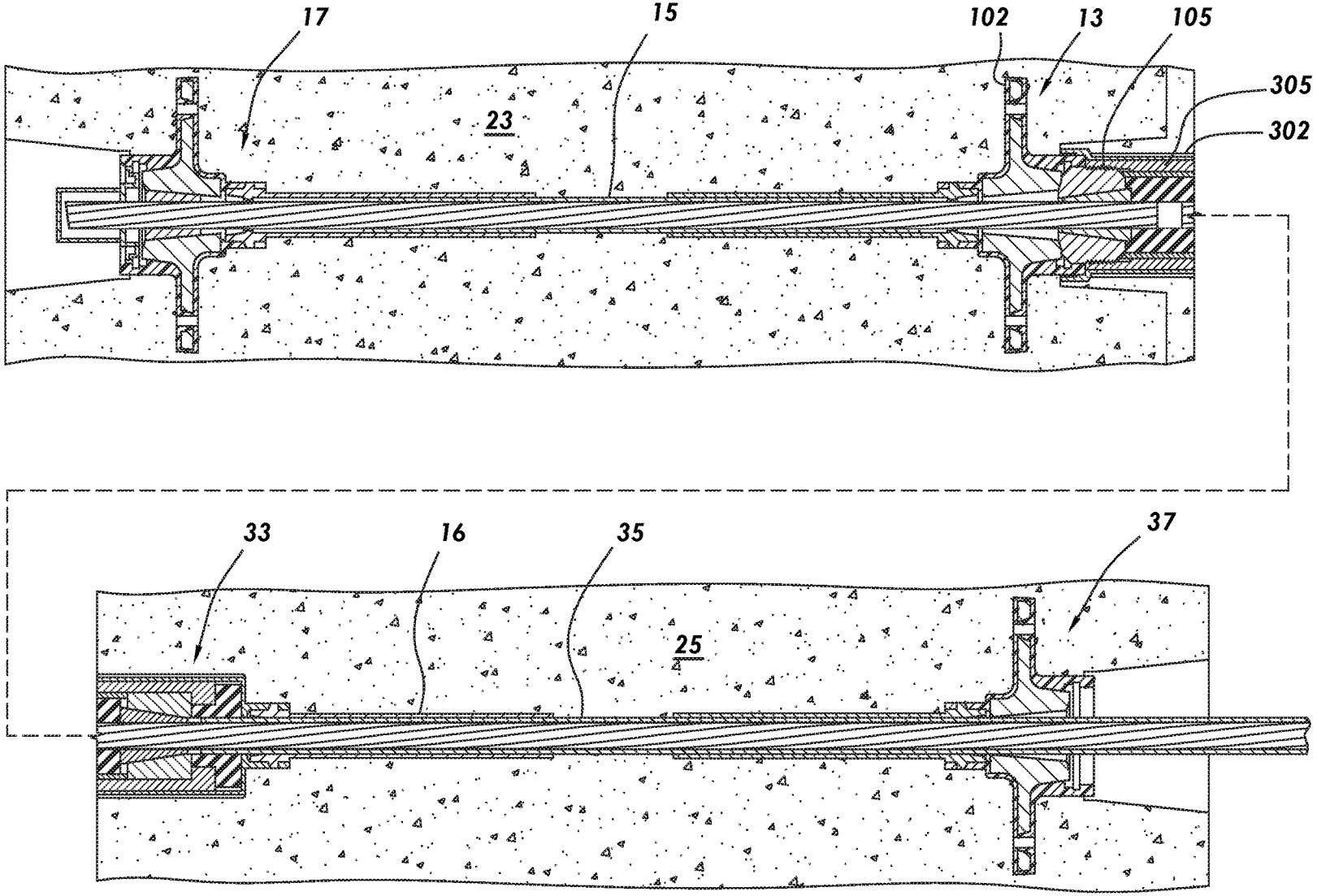
FIG. 4 is a cross section showing a still further step in a concrete pouring operation, consistent with at least one embodiment of the present disclosure.
Figure 5:
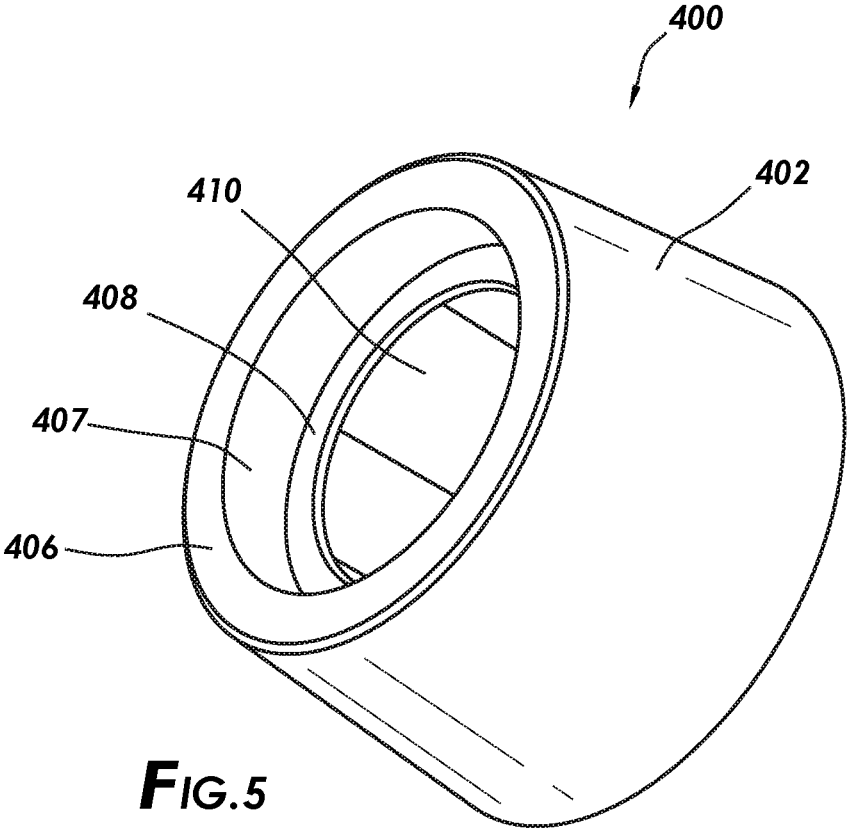
FIG. 5 is a perspective view of a pocket-forming cap consistent with at least one embodiment of the present disclosure.

Referring now to FIG. 4, coupler 33 is shown fully engaged with first anchor 13, with connector 305 threadedly engaging connector anchor 105 and coupler encapsulation 302 sealingly engaging anchor encapsulation 102 and seal 16. Coupler encapsulation 302 may, for example, protect coupler body 301 from corrosion after second concrete section 25 is poured. Additionally, coupler encapsulation 302 may, for example, reduce or prevent concrete or liquids from ingressing into coupler body 301 and second tension member 35, which might prevent or retard tensioning.

With coupler 33 and further third anchor 37 in place and second tension member 35 extending therebetween and engaged thereby, concrete can be poured between first concrete section 23 and second concrete form 41 so as to form a second concrete section 25. In some embodiments, concrete may flow into pocket 29, embedding first anchor 13 and coupler 33. Once second concrete section 25 has cured sufficiently, second tension member 35 can be used to post-tension second concrete section 25 at further third anchor 37. If it is desired to include third or further concrete sections (not shown), further third anchor 37 may function in the manner described above with respect to first anchor 13, i.e. further third anchor 37 may be connected to a coupler and serve as a fixed anchor for an additional tendon (not shown).

Provided one end of first tension member 15 is gripped by connector anchor 105, the first concrete section can be post-tensioned from second anchor 17 and it is not necessary to maintain access to first tension member 15 at first anchor 13. Thus, it is not necessary to wait for the first concrete section to cure before assembling a second post-tensioning tendon 31 and pouring the second concrete section. This results in substantial time savings. In addition, because first anchor 13 serves as a fixed anchor, first tension member 15 does not need to extend beyond first anchor 13 sufficiently to serve as the tension member for second concrete section 25. This in turn may facilitate connections at first anchor 13. Because connector anchor 105 can be retained to first anchor 13 by engagement with anchor encapsulation 102 and by the action of first tension member 15 on wedges 107, connector anchor 105 can be used with any anchor and it is not necessary to provide a specialized interface or connection.

With coupler 33 in place, first anchor 13 and coupler 33 combine to form an intermediate anchor that serves as a fixed anchor to both first and second post-tensioning tendons 11, 31. The connection of coupler 33 to first anchor 13 allows force to be transferred between first and second post-tensioning tendons 11, 31 even though the tension members are discontinuous (i.e., first and second tension members 15, 35). Because the wedge-receiving frustoconical portion 306 of coupler body 301 is oriented oppositely to the wedge-receiving frustoconical portion 106 of connector anchor 105, a tensioning force can be transmitted from coupler body 301 to connector 305, from connector 305 to connector anchor 105, and from connector anchor 105 to first tension member 15.

Each of first and second concrete sections 23, 25 can be post-tensioned at its respective stressing anchor. Specifically, first concrete section 23 can be post-tensioned by applying a tensioning force to an end of first tension member 15 extending from second anchor 17 and second concrete section 25 can be post-tensioned by applying a tensioning force to an end of second tension member 35 extending from further third anchor 37. Stressing of concrete sections 23, 25 can be sequential or simultaneous. By way of example only, in some embodiments, the second tendon may be stressed before the first tendon. The wedges in each anchor grip the respective tension member in response to a tensioning force so as to retain it in tension and thereby apply a compressive force to the respective concrete section. If desired, a portion of a tension member extending beyond a stressing anchor after tensioning can be removed and the remaining cable end may be capped or otherwise secured or enclosed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Further, it will be understood that, unless explicitly so recited, a sequential recitation of steps in the claims that follow is not intended to require that the steps be performed sequentially.

What is claimed is:

1. A system for use with an anchor of a post-tensioning tendon, comprising:

a connector anchor including a bore therethrough wherein the connector anchor is adapted to mechanically couple to the post-tensioning concrete anchor; and a coupler, the coupler comprising:

a coupler body including a bore therethrough; and a connector having a bore therethrough and configured to receive the coupler body therein, the connector adapted to mechanically engage the connector anchor such that a tensioning force can be transmitted from the coupler body to the connector anchor via the connector; and a pocket-forming cap engaged to the connector anchor, the pocket-forming cap including a frustoconical pocket-forming wall, a gripping head, and a connector-receiving portion, wherein the pocket-forming wall includes a removable boss.

2. The system of claim 1 wherein the anchor includes an anchor body, wherein the anchor body includes an anchor encapsulation, and wherein the pocket-forming cap is adapted to releasably engage the anchor body or the anchor encapsulation.

3. The system of claim 1, further including a coupler encapsulation encapsulating an outer surface of the connector and a tubular seal mechanically coupled to the coupler encapsulation.

4. The system of claim 1, further including a first spacer retained in the connector so as to retain the coupler body in the connector.

5. The system of claim 4, further including a second spacer disposed between the coupler encapsulation and an end of the connector.

6. The system of claim 1, wherein the gripping head is adapted to grip, rotate, replace, or remove the pocket-forming cap.

7. The system of claim 1, wherein the boss is adapted to form a groove in a concrete pocket formed by the pocket-forming cap.

8. The system of claim 1, wherein the pocket-forming wall extends from a base to a lip, wherein the lip is adapted to bear on an inner surface of a concrete form.

9. The system of claim 8, wherein a largest diameter of the pocket-forming wall is at the lip and a smallest diameter of the pocket-forming wall is at the base.

10. The system of claim 1, wherein the gripping head extends along a longitudinal axis of the pocket-forming cap.

11. The system of claim 1, wherein the pocket-forming cap has an anchor seat, the anchor seat axially spaced from a base of the pocket-forming cap.

12. The system of claim 11, wherein the connector-receiving portion is bounded by a shoulder and an inner wall of the pocket-forming cap.

* * * * *